US005378592A

United States Patent [19]

Nakanishi et al.

[11] Patent Number: 5,378,592

[45] Date of Patent: Jan. 3, 1995

[54] PHOTOGRAPHIC MATERIAL

[75] Inventors: Ken Nakanishi; Tadashi Takehana; Hiroyuki Tamaki; Sumio Nishikawa, all of Shizuoka, Japan

[73] Assignee: Fuji Photo Film Co., Ltd., Kanagawa, Japan

[21] Appl. No.: 190,542

[22] Filed: Feb. 2, 1994

[30] Foreign Application Priority Data

Feb. 2, 1993 [JP] Japan ..... 5-015344

[51] Int. Cl.[6] ..... G03C 1/76

[52] U.S. Cl. ..... 430/533; 430/523; 430/531

[58] Field of Search ..... 430/271, 523, 531, 533, 430/539

[56] References Cited

U.S. PATENT DOCUMENTS 3,791,857 2/1974 Balle et al. ..... 430/533

5,194,347 3/1993 Vermeulen et al. ..... 430/533

*Primary Examiner*—Jack P. Brammer

*Attorney, Agent, or Firm*—Birch, Stewart, Kolasch & Birch

[57] ABSTRACT

A photographic material comprises a support of a polyester film, a first subbing layer provided thereon, a second subbing layer comprising gelatin provided on the first subbing layer and a photographic layer provided on the second subbing layer. The first subbing layer is a layer of polyurethane latex cured with an epoxy compound or a dichloro-s-triazine derivative, otherwise the first subbing layer comprises a polymer which has breaking elongation of not more than 300% or stress at 100% elongation of not less than 130 kg/cm$^2$.

4 Claims, No Drawings

PHOTOGRAPHIC MATERIAL

FIELD OF THE INVENTION

The present invention relates to a photographic material which comprises a polyester film, two subbing layers provided on the film and a photographic layer.

BACKGROUND OF THE INVENTION

As materials for a support for a photographic material, poly(ethylene terephthalate), triacetyl cellulose, polystyrene, polycarbonate, a laminate of polyolefin laminate and a paper are usually employed due to their excellent transparency. However, such polymer film has a hydrophobic surface, and therefore it is difficult to firmly bond a photographic emulsion layer comprising a hydrophilic polymer (hydrophilic colloid) mainly containing gelatin on the support of the polymer in the case of employing the polymer as the base film of the support for the photographic material.

Two processes can be utilized as a conventional technique which has been tried to overcome the above difficulty:

(1) a process in which after providing a surface activation treatment such as a chemical treatment, a mechanical treatment, a corona discharge treatment, a flame treatment, a UV treatment, a high frequency wave treatment, a glow discharge treatment, an active plasma treatment, a mixed acid treatment and an ozone oxidation treatment, a photographic emulsion layer is directly formed on the support to obtain a high bonding strength; and (2) a process in which a subbing layer is provided on the support subjected to the above surface treatment by coating, and then a photographic emulsion layer is formed thereon.

The latter process (2) is effective so that it is widely performed.

It is assumed that any of these surface treatments is effected by forming some polar groups on a surface of a base film which is originally hydrophobic and by increasing a cross linking density on a surface, and as a result, it is considered that the affinity of the components contained in a subbing layer with the polar group is increased or the bonding strength between the subbing layer and the base film is enhanced.

Further, various devices are given to the constitution of the subbing layer. There are a multi-layer process in which a layer bonding strongly to a base film (hereinafter referred to as the first subbing layer) is provided as the first layer and a hydrophilic resin layer bonding strongly to a photographic layer is provided thereon as the second layer, and a single layer process in which only a resin layer containing both a hydrophobic group and a hydrophilic group is coated over a base film.

The single layer process, for example, comprising the steps of coating an organic solvent on a poly(ethylene terephthalate) film (which is a representative support for a photographic material) to form a surface having a fine unevenness for the purpose of giving anchoring effect and forming a gelatin layer on the surface. The process is advantageous for obtaining a high bonding strength between a support and a photographic layer (emulsion layer).

However, since the process for the formation of the subbing layer employs the organic solvent, working conditions for performing the process is poor for a worker. Further, there are danger of occurrence of fire and fear of bringing about air pollution. Hence, the process for the formation of the subbing layer using no organic solvent is greatly desired.

As a process for the formation of the subbing layer using no organic solvent (i.e., in water system), for example, there is proposed various processes comprising the steps of coating a polymer latex on a polyester support to form a first subbing layer and forming a hydrophilic colloidal layer comprising gelatin on the first subbing layer. Examples of polymers of the polymer latexes using for the processes include copolymers derived from at least two monomers selected from vinyl chloride, vinylidene chloride, butadiene, methacylic acid, acrylic acid, itaconic acid and maleic anhydride, polyethylene imine, epoxy resin-grafted gelatin, and nitrocellulose.

Particularly, there has been studied the use of a copolymer derived from monomers containing vinylidene chloride or from monomers containing diene (e.g., butadiene) for the first subbing layer in order to enable the formation of the subbing layer in water system by which high bonding strength between the photographic layer and the support of polyester can be obtain.

As a first subbing layer giving the above high bonding strength, the first subbing layer which comprises a copolymer derived from monomers containing diene or combination of the polymer and an appropriate agent for bridge formation (e.g., dichloro-s-triazine) is disclosed (e.g., U.S. Pat. No. 4,542,093, and Japanese Patent Provisional Publications No. 61(1986)-105543 and No. 61(1986)-107343).

However, in the case that after the above subbing layer is provided on a support, a gelatin layer is formed on the subbing layer and a photographic layer and a backing layer are formed on the gelatin layer, the resultant composite (photographic material) is allowed to stand in the condition of a low humidity (10–30% RH), cracking is apt to be produced on the emulsion layer and the backing layer. It is assumed that the photographic layer is shrunk receiving change of humidity owing to a low elastic modulus of the diene-copolymer.

Further, as a first subbing layer giving the above high bonding strength between the support and the photographic layer, a subbing layer which comprises a copolymer derived from monomers containing vinylidene chloride or combination of the polymer and an appropriate agent for bridge formation (e.g., both of dichloro-s-triazine and epoxy compound) is disclosed (e.g., Japanese Patent Provisional Publications No. 1(1989)-180537, No. 1(1989)-209443 and No. 3(1991)-109545).

The photographic material obtained by the use of the above subbing layer does not produce the cracking of the emulsion layer caused by change of humidity around the material. However, in the case that the material is left in the condition of a high humidity for a long time period (e.g., three days), the bonding strength between the support and the first subbing layer is lowered, which results in reduction of the bonding strength between the support and the photographic layer.

Thus, the photographic materials obtained by the use of the above subbing layers do not overcome either the cracking caused by change of humidity around the material or the deduction of bonding strength under the circumstances of a high humidity.

In the photographic material having the first subbing layer and the second subbing layer of gelatin, the photographic emulsion layer is frequently damaged (i.e., suffers from scratch) during a developing operation owing to a foreign matter attached to a roller of the developing machine. Such damage results in formation of pinhole on the emulsion layer after drying the material. Further, in the photographic material having the two subbing layers, when the second subbing layer is formed on the first subbing layer provided on the support, reticulation of the second subbing layer is produced receiving change of humidity. If a coating solution for a photographic emulsion layer or a backing layer is coated at a high coating speed on the second subbing layer having such reticulation, the coated layer exhibits a nonuniform surface. Although the occurrence of the reticulation can be prevented by controlling humidity around the material, a curing rate of the emulsion layer or the backing layer is influenced by a change of humidity.

SUMMARY OF THE INVENTION

It is an object of the present invention to provide a photographic material which does not reduce a bonding strength between the support and a photographic layer under the circumstances of a high humidity for a long time period, the material having both a first subbing layer of polymer latex and a second subbing layer of gelatin on the support.

Further, it is an object of the invention to provide a photographic material which does not produce cracking on a photographic layer provided on the subbing layer under the circumstances of a low humidity for a long time period.

Furthermore, it is an object of the invention to provide a photographic material which does not have reticulation or pinhole.

There is provided by the present invention a photographic material comprising a support of a polyester film, a first subbing layer provided thereon, a second subbing layer provided on the first subbing layer and a photographic layer provided on the second subbing layer, wherein the first subbing layer is a layer of polyurethane latex cured with an epoxy compound or a dichloro-s-triazine derivative, and the second subbing layer is a hydrophilic colloid layer comprising gelatin.

The preferred embodiments of the photographic material of the invention are as follows:

(1) The photographic material wherein the polyurethane latex has breaking elongation (extension) of not more than 300% or stress at 100% elongation of not less than 130 kg/cm$^2$.

(2) The photographic material wherein the polyurethane latex is a latex of polyurethane derived from an iscocyanate compound and at least one polyol selected from the group consisting of polyol containing a polycarbonate unit, polyol of an aliphatic polyester and polyol of polyester containing a poly(ethylene phthalate) unit.

(3) The photographic material wherein the polyurethane latex is a latex of polyurethane derived from an iscocyanate compound and polyol containing a polycarbonate unit.

(4) The photographic material wherein the polyurethane latex is a latex of polyurethane derived from an iscocyanate compound and polyol of an aliphatic polyester or polyol containing a poly(ethylene phthalate) unit.

(5) The photographic material wherein the polyurethane latex has a mean particle size of 0.01 to 0.5 μm (more preferably 0.03 to 0.1 μm).

(6) The photographic material wherein the polyurethane latex has a melting point of 100° to 180° C. (more preferably 120° to 160° C.).

(7) The photographic material wherein the a dichloro-s-triazine derivative is sodium 2,4-dichloro-6-hydroxy-s-triazine.

(8) The photographic material wherein the epoxy compound has epoxy groups of not less than 4 (preferably 4 to 5).

(9) The photographic material wherein the epoxy compound is a sorbitol compound or sorbitan compound having epoxy groups of not less than 4 (preferably 4 to 5).

(10) The photographic material wherein the polyester film is subjected to a biaxial stretching treatment.

(11) The photographic material wherein the first and second subbing layers are provided on the surface opposite to the photographic layer of the support.

(12) The photographic material as described in (11) wherein the backing layer is provided on the second subbing layer.

There is also provided by the invention a photographic material comprising a support of a polyester film, a first subbing layer provided thereon, a second subbing layer provided on the first subbing layer and a photographic layer provided on the second subbing layer, wherein the first subbing layer comprises a polymer which has breaking elongation (extension) of not more than 300% or stress at 100% elongation of not less than 130 kg/cm$^2$, and the second subbing layer is a hydrophilic colloid layer comprising gelatin.

The preferred embodiments of the photographic material of the invention are as follows:

(1) The photographic material wherein the breaking extension in the range of 5 to 270%.

(2) The photographic material wherein the stress at 100% elongation is in the range of 130 to 400 kg/cm$^2$.

(3) The photographic material wherein the first subbing layer is a layer of the polymer cured with an epoxy compound or a dichloro-s-triazine derivative.

(4) The photographic material wherein the first subbing layer is a layer of the polymer cured with a dichloro-s-triazine derivative.

(5) The photographic material wherein the first subbing layer is a layer of the polymer cured with sodium 2,4-dichloro-6-hydroxy-s-triazine.

(6) The photographic material wherein the polymer is at least one polymer selected from the group consisting of polyurethane latex, an acrylic resin latex and a styrene/butadiene copolymer latex.

(7) The photographic material wherein the polyester film is subjected to a biaxial stretching treatment.

(8) The photographic material wherein the first and second subbing layers are provided on the surface opposite to the photographic layer of the support.

In the photographic material of the invention, the first subbing layer which strongly bonds to the support of a polyester film and to which the second subbing layer of gelatin strongly bonds is provided on the support and the second subbing layer to which the photographic layer strongly bonds is provided on the first subbing layer. Therefore, bonding strength between the support and the photographic layer exhibits a high strength. Further, the high bonding strength does not reduce under the circumstances of a high humidity for a long time period and does not produce cracking on the photographic layer under the circumstances of a low humidity for a long time period, because the first subbing layer is a layer of polyurethane latex cured with an epoxy compound or a dichloro-s-triazine derivative or has the specific breaking extension or stress at 100% elongation. Furthermore, the first subbing layer does not produce reticulation or pinhole to give a good coating property to the photographic layer provided on the subbing layer.

DETAILED DESCRIPTION OF THE INVENTION

The photographic material of the invention has a basic structure consisting of a support of a polyester film, a first subbing layer, a second subbing layer and a photographic layer.

As materials of the polyester film for the support, various polyesters can be employed. Preferred examples of the materials include poly(ethylene terephthalate) namely PET, poly(1,4-cyclohexanedimethylene terephthalate), poly(ethylene 1,2-diphenoxyethane-4,4-dicarboxylate). PET is further preferred. Particularly, PET which has been subjected to a diaxial stretching treatment and a heat-fixed treatment is preferable selected from the viewpoint of chemical and physical stability and toughness. An average molecular weight of the polyester employed in the invention preferably is in the range of about 10,000 to about 500,000.

A thickness of the polyester film generally is in the range of 15 to 500 μm, and preferably is in the range of 40 to 200 μm from the viewpoint of handling and availability. The film may be as it is, i.e., may be transparent, otherwise may contain dyed silicon, alumina sol, chromium salt and zirconium salt.

The first subbing layer of the invention is a layer of polyurethane latex cured with an epoxy compound or dichloro-s-triazine derivative (or may be a layer of polyurethane latex cured with an epoxy compound and dichloro-s-triazine derivative); otherwise the first subbing layer is a layer comprising a polymer which has breaking extension of not more than 300% or stress at 100% elongation of not less than 130 kg/cm$^2$ and preferably is a layer of the polymer cured with an epoxy compound or dichloro-s-triazine derivative.

The polyurethane for the polyurethane latex of the invention is a polymer having urethane bond. The polyurethane is usually derived from an isocyanate compound (preferably a polyisocyanate compound) and a polyol.

Examples of the polyol include:

glycols such as trimethylene glycol, tetramethylene glycol, pentamethylene glycol, hexamethylene glycol, decamethylene glycol, diethylene glycol, p-xylylene glycol, pinacol, propylene glycol, hydrobenzoin, benzopinacol, cyclopentane-1,2-diol, cyclohexane-1,2-diol, cyclohexane-1,4-diol, bis(4-oxyphenyl)methane, 1,1-bis(4-oxyphenyl)ethane, 1,1-bis(4-oxyphenyl)butane, 1,1-bis(4-oxyphenyl)isobutane, 1,1-bis(4-oxyphenyl)cyclohexane, 1,1-bis(4-oxyphenyl)propane and carbonate of 1,1-bis(4-oxyphenyl)butane; and polyesters (preferably having a hydroxy group at end positions) derived from at least one of dibasic acids such as terephthalic acid, isophthalic acid, maleic acid, oxalic acid, malonic acid, succinic acid, glutaric acid, adipic acid, pimeric acid, suberic acid, azelaic acid, sebasic acid and fumaric acid, and at least one of glycols such as trimethylene glycol, tetramethylene glycol, pentamethylene glycol, hexamethylene glycol, decamethylene glycol, diethylene glycol, p-xylylene glycol, pinacol, propylene glycol, hydrobenzoin, benzopinacol, cyclopentane-1,2-diol, cyclohexane-1,2-diol, cyclohexane-1,4-diol, bis(4-oxyphenyl)methane, 1,1-bis(4-oxyphenyl)ethane, 1,1-bis(4-oxyphenyl)butane, 1,1-bis(4-oxyphenyl)isobutane, 1,1-bis(4-oxyphenyl)cyclohexane, 1,1-bis(4-oxyphenyl)propane and 1,1-bis(4-oxyphenyl)butane.

Preferred polyols employed in the polyurethane are polyol containing polycarbonate unit, polyol of aliphatic polyester and polyol of polyester containing poly(ethylene terephthalate) unit.

Examples of the isocyanate include hexamethylene diisocyanate, p-phenylene diisocyanate, methylene diisocyanate, ethylene diisocyanate, trimethylene diisocyanate, tetramethylene diiscyanate, pentamethylene diiscyanate, octamethylene diisocyanate, decamethylene diisocyanate, cyclohexane diisocyanate, m-phenylene diisocyanate, o-phenylene diisocyanate, methyl-2,5-phenylene diisocyanate, tolylene diisocyanate, xylylene diisocyanate, isophoron diisocyanate and 1,5-naphthylene diisocyanate.

The polyurethane containing a polycarbonate unit, which is derived from the polycarbonate polyol (polyol containing polycarbonate unit) and the polyisocyanate, preferably has the following structure [1].

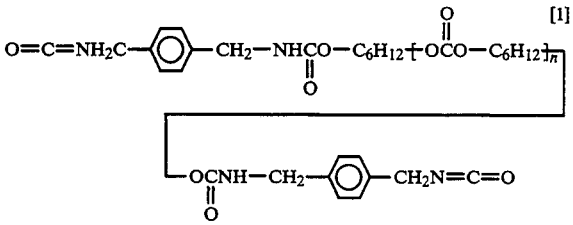

[1]

in which n is 200 to 400.

The polyurethane containing an aliphatic polyester unit, which is derived from the aliphatic polyester polyol (polyol of aliphatic polyester ) and the polyisocyanate, preferably has the following structure [2].

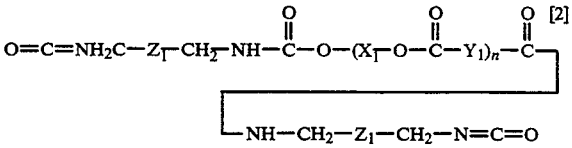

[2]

in which $X_1$ is $-C_2H_4-$, $-C_3H_6-$ or $-C_4H_8$, $Y_1$ is $-C_6H_{12}-$, $-C_7H_{14}-$ or $-C_8H_{16}$, $Z_1$ is phenylene or $-C_6H_{12}-$ and n is in the range of 200 to 400.

The polyurethane containing a poly(ethylene terephthalate) unit, which is derived from the polyol containing poly(ethylene terephthalate) unit and the polyisocyanate, preferably has the following structure [3].

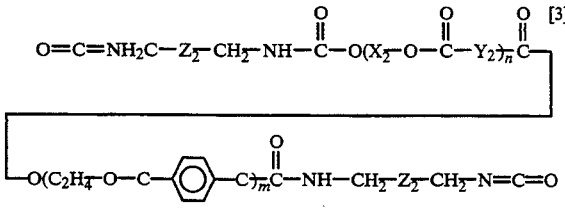

[3]

in which $X_2$ is $-C_2H_4-$, $-C_3H_6-$ or $-C_4H_8$, $Y_2$ is $-C_6H_{12}-$, $-C_7H_{14}-$ or $-C_8H_{16}$, $Z_2$ is phenylene or —$C_6H_{12}$—, n is in the range of 100 to 300 and m is in the range of 50 to 150.

The polyurethane latexes are, for example, prepared by emulsifying the above polyurethanes and the resultant polyurethane latexes generally have a carboxy group in the amount of 0.2 to 0.4 millimole/g and/or a hydroxy group in the amount of 0.1 to 0.3 millimole/g.

The polyurethane latex employed in the invention is preferred to be a self-emulsifiable-type (or self-dispersable-type) polyurethane, which is capable of dispersing in water with no surface active agent. Particularly, the self-emulsifiable-type polyurethane preferably has an anionic property (e.g., polyurethane having carboxy or sulfo group).

The polyurethane latex preferably has a mean particle size of 0.01 to 0.5 μm and more preferably 0.03 to 0.1 μm. Further, the polyurethane latex preferably has a melting point of 100° to 180° C. and more preferably 120° to 160° C.

As the polymer which has breaking elongation of not more than 300% (preferably 5 to 270%) or stress at 100% elongation of not less than 130 kg/cm$^2$ (preferably 130 to 400 kg/cm$^2$), any polymer is employable so long as satisfies these characteristics. Preferred examples of the polymer include polyurethanes as mentioned above, acrylic resins such as a homopolymer derived from an acrylic acid ester or methacrylic acid ester and a copolymer derived from acrylic acid esters and/or methacrylic acid esters and dien polymers such as styrene/butadiene copolymers (e.g., styrene/butadiene rubber (SBR)). Such polymers preferably have Tg (glass transition temperature) of not lower than 20° C. and more preferably Tg of 60° to 90° C. The styrene/butadiene copolymer preferably has styrene unit of not less than 65 weight % in its molecule and further preferably has gel portion rate of not less than 90 weight %. Such polymers may be used singly or in combination. Other than these polymers, polyvinylidene chloride such as a homopolymer of vinylidene chloride or a copolymer containing vinylidene chloride may be used in combination with the polymers. The polymers are preferred to be polymer latexes. The first subbing layer preferably is a layer of the polymer cured with an epoxy compound or a dichloro-s-triazine derivative.

However, the polyurethane gives effect of the invention even if it does not satisfy the breaking extension and stress, although it is preferred that the polyurethane satisfies the breaking extension and stress.

In the photographic material having the first subbing layer using the above polymer having the specific breaking extension or stress, the photographic layer is scarcely damaged during a developing operation owing to a foreign matter attached to a roller of the developing machine. Hence, there is little occurrence of pinhole on the emulsion layer after drying the material. Further, when the second subbing layer is formed on the above first subbing layer provided on the support, reticulation of the second subbing layer is not produced receiving change of humidity. Even if a coating solution for a photographic emulsion layer or a backing layer is coated at a high coating speed on the second subbing layer having such reticulation, the coated layer exhibits uniform surface. The first subbing layer of the invention contains a dichloro-s-triazine derivative or epoxy compound as a bridging agent.

The dichloro-s-triazine derivative preferably has one of the following formulae:

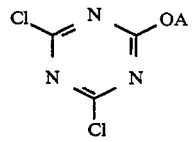

wherein "A" represents an alkyl group, a cycloalkyl group, an aryl group, an aralkyl group, a metal atom or a hydrogen atom.

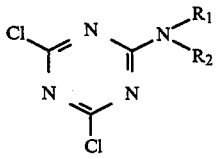

wherein each of $R^1$ and $R^2$ represents an alkyl group, a cycloalkyl group, an aryl group, an aralkyl group or $NHR^3$ in which $R^3$ stands for an alkyl group or an acyl group, and $R^1$ and $R^2$ may be linked together or may form a 5- or 6-membered ring containing oxygene or SN—$R^4$ in which $R^4$ stands for an alkyl group.

In the above formulae, "A" preferably represents an alkyl group having 1–8 carbon atoms (preferably represents methyl, isopropyl, n-butyl), a phenyl group which may be substituted with methyl or chlorine, a benzyl group, or sodium. Each of $R^1$ and $R^2$ preferably represents an alkyl group having 1–12 carbon atoms (preferably represents methyl, n-butyl or dodecyl), a phenyl group which may be substituted with methyl or chlorine, a benzyl group, an anilino group or a cyclohexyl group or $R^1$ and $R^2$ represent anilino group or a cyclohexyl group or $R^1$ and $R^2$ represent ethylene and they form a 6-membered ring through O, S or $NCH_3$.

The above dichloro-s-triazine derivative is preferably contained in the polymer of the first subbing layer in the amount of 0.001 to 200 weight % based on the amount of the polymer such as polyurethane latex, and more preferably in the amount of 0.01 to 20 weight % and most preferably in the amount of 0.01 to 5 weight %.

Preferred example of the dichloro-s-triazine derivative is sodium 2,4-dichloro-s-triazine having the following formula:

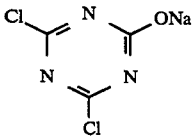

As materials of the epoxy compound of the invention, compounds generally have three or more epoxy groups (glycidyl groups), more preferably have four or more epoxy groups and particularly have four to five epoxy group. Further, the epoxy compound preferably is a sorbitol compound or sorbitan compound having epoxy groups of not less than 4 and more preferably epoxy groups of 4 to 5.

The above epoxy compound is preferably contained in the subbing layer in the amount of 0.001 to 200 weight % based on the amount of the polymer such as polyurethane latex, more preferably in the amount of 0.01 to 20 weight % and most preferably in the amount of 0.1 to 20 weight %.

Preferred example of the epoxy compound is set forth below.

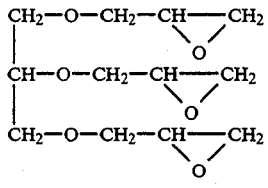

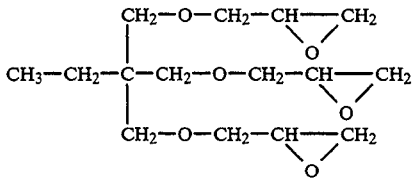

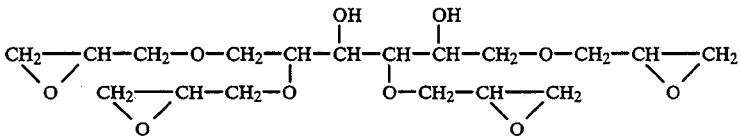

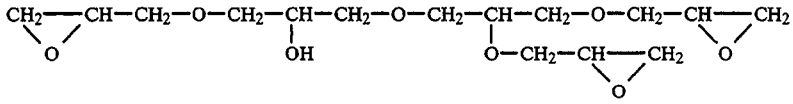

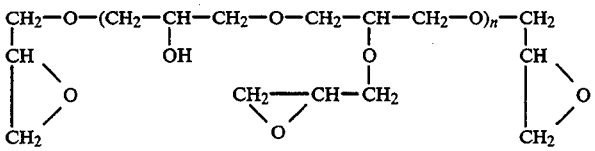

n: approx. 2 or 3

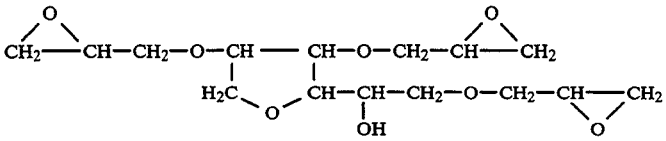

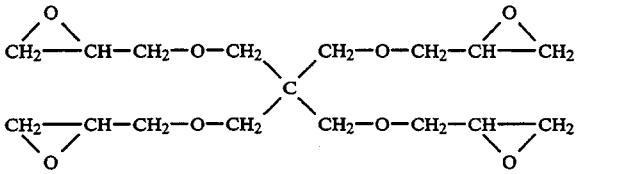

The above dichloro-s-triazine derivative or the epoxy compound may be employed in the combination of the following compounds: triazine compounds described in U.S. Pat. No. 3,325,287, U.S. Pat. No. 3,288,775 and U.S. Pat. No. 3,549,377, and Belgian Patent No. 6,602,226; dialdehyde compounds described in U.S. Pat. No. 3,291,624 and U.S. Pat. No. 3,232,764, French Patent No. 1,543,694, and British Patent No. 1,270,578; epoxy compounds described in U.S. Pat. No. 3,091,537 and Japanese Patent Publication No. 49(1964)-26580; vinyl compounds described in U.S. Pat. No. 3,642,786; aziline compounds described in U.S. Pat. No. 3,392,024; ethyleneimine compounds described in U.S. Pat. No. 3,549,378; and water-soluble melamine compounds described in Japanese Patent Provisional Publication No. 63(1988)-125357.

The first subbing layer may contain a swelling agent (which swell the polyester film) such as phenol or resorcin. The swelling agent is generally used by addition of 1 to 10 gram per the coating solution for the first subbing layer of 1 little.

The first subbing layer may contain a hydrophilic polymer such as gelatin, gelatin derivatives, casein, agar, sodium alginate, starch, polyvinyl alcohol, a vinyl acetate/maleic anhydride copolymer, an acrylic acid/acrylamide copolymer, or a styrene/maleic anhydride copolymer.

The first subbing layer may contain as an anti-blocking agent a matting agent such as silicon dioxide, polymethylmethacrylate or polystyrene; or a water-soluble polymer such as methylcellulose or polyvinyl alcohol.

Further, a coating solution for forming the first subbing layer may contain various additives other than the above compounds. For instance, examples of the additives include a surface active agent, an antistatic agent, an antihalation agent, a coloring dye, a pigment, a coating aid and an antifogging agent.

The coating solution for the first subbing layer can be coated by known coating methods such as a dip coating method, a roller coating method, a curtain coating method, an air knife coating method, a wire bar coating method, a gravure coating method or an extrusion coating method using a hopper described in U.S. Pat. No. 2,681,294. Two or more layers can be simultaneously be coated according to the processes described in U.S. Pat. Nos. 2,761,791, 3,508,947, 2,941,898 and 3,526,528, and "Coating Technology" written by Y. Harasaki, page 253 (published by Asakura Book, 1973), if desired.

The first subbing layer and a second subbing layer (described later) which is provided on the first subbing layer described later, are preferably formed in a coating amount of 0.01 to 10 g per a polyester film of 1 $m^2$, and more preferably formed in a coating amount of 0.2 to 3 g.

In the invention, the second subbing layer is formed on the first subbing layer as mentioned above. Further, the second subbing layer is preferred to be a hydrophilic colloid layer in which gelatin is contained as a main ingredient. Examples of the hydrophilic polymers other than gelatin employable for the second subbing layer include acylated gelatins such as phthalic gelatin and maleic gelatin, a grafted gelatin such as acrylic acid, methacrylic acid or acrylamide-grafted gelatin, cellulose derivatives such as carboxymethylcellulose and hydroxyethylcellulose, polyvinyl alcohol, polyhydroxyalkylacrylate, polyvinylpyrrolidone, vinylpyrrolidone/vinyl acetate copolymer, casein, agar, albumin, sodium alginate, polysaccharide, agar, a grafted agar, polyacrylamide, an acylated polyethyleneimine, and a homopolymer or copolymer containing acrylic acid, acrylamide or N-substituted acrylamide; or partial hydrolyzed compound of these compounds. They are employed singly or in combination.

The second subbing layer may contain an antistatic agent, an agent for bridging, a matting agent and a antiblocking agent if desired, in addition the binder of the above polymer.

The backing layer can employ, as a binder, a hydrophobic polymer or a hydrophilic polymer as used for the subbing layer.

The backing layer may contain an antistatic agent, a sliding agent, a matting agent, a surface active agent and a dye.

The photographic layer (emulsion layer) provided on the second subbing layer is described in brief below. The photographic layer is a hydrophilic colloid layer in which a hydrophilic polymer such as gelatin is contained as a main ingredient.

Examples of binders employed in the photographic layer include hydrophilic polymers include gelatin, acylated gelatins such as phthalic gelatin and maleic gelatin, a grafted gelatin such as acrylic acid, methacrylic acid or acrylamide-grafted gelatin, cellulose derivatives such as carboxymethylcellulose and hydroxyethylcellulose, polyvinyl alcohol, polyhydroxyalkylacrylate, polyvinylpyrrolidone, vinylpyrrolidone/vinyl acetate copolymer, casein, agar, albumin, sodium alginate, polysaccharide, agar, a grafted agar, polyacrylamide, an acylated polyethyleneimine, and a homopolymer or copolymer containing acrylic acid, acrylamide or N-substituted acrylamide; or partial hydrolyzed compound of these compounds. They are employed singly or in combination. Preferred hydrophilic polymers are gelatin and gelatin derivatives (acylated gelatin and grafted gelatin).

The first subbing layer gives an excellent effect of the invention (e.g., high bonding strength between the support and a photographic under high humidity, and no occurrence of cracking on a photographic layer under low humidity) in the case of using the above photographic layer. Hence, the photographic layer is formed on the second subbing layer in the invention.

To the binder of such photographic layer, a physical development nucleus such as silver halide or silver sulfide used in a diffusion transfer photographic process, photosensitive materials such as a diazo compound and various additives such as coupler, emulsifying agent and polymer latex, are usually added.

In the photographic layer, the various materials which include a silver halide particle, a chemical sensitizer, dyes, a polymer latex, a surface active agent, a hardening agent for gelatin, a color coupler, a fading inhibitor, an antistatic agent and a matting agent, can be employed with no specific restriction. The additives used in the photographic layer are described, for example, in Research Disclosure No. 176, pages 22–31 (December, 1978).

The surface treatment such as a corona discharge treatment may be carried out on not only a surface of the polyester film but also any surface of the first subbing layer and the second subbing layer, if desired. The treatment enhances bonding strength between layers.

The present invention is further described by the following examples.

The measuring methods performed in the Examples are explained below.

(1) Bonding strength between support and photographic layer i) The following test is carried out as to the photographic film (material) after coating of a coating solution for a photographic layer and the photographic film after treatments comprising development, fixing and washing. Six notches at each of long and width directions at interval 3–5 mm are cut on the surface of the photographic layer to form 25 (5×5) boxes. A cellophane tape (Nitto polyester adhesive tape No.31 available from Nitto Kogyo Co., Ltd.) is allowed to adhere to the boxes and the tape is peeled to count the removed boxes of the photographic layer. Bonding strength between the support and the photographic layer is evaluated according to the number of the removed boxes as follows:

AA: the removed boxes are zero.

BB: the removed boxes are 1 to 2.

CC: the removed boxes are 3 to 4.

DD: the removed boxes are not less than 5.

ii) The following test is carried to evaluate the bonding in the treatment solutions during the treatments. The edge of the emulsion layer is rubbed 15 times with a finger and a length of the photographic layer peeled from the support at the edge is measured to evaluate as follows:

AA: the length is zero.

BB: the length is less than 2 mm.

CC: the length is 2 to 4.

DD: the length is more than 4.

The treatments are performed according to a tray development process by employing LDS-715 (available from Fuji Photo Film Co., Ltd.) as a developing solution of the treatment solutions and LF-308 (available from Fuji Photo Film Co., Ltd.) as a developing solution of the treatment solutions.

The photographic film evaluated as "AA" and "BB" in the tests can be employed in practice.

(2) Bonding strength between support and photographic layer under high humidity i) The photographic films, which are obtained by formation of the photographic layer, are subjected to the treatments comprising development, fixing and washing. The treated films are allowed to stand in the high humidity condition of 25° C., 90% RH for three days or more. On the surface of the photographic layer of the obtained films, six notches at each of long and width directions at interval 3–5 mm are cut to form 25 (5×5) boxes. A cellophane tape (one used in above (1)) is allowed to adhere to the boxes and the tape is peeled to count the removed boxes of the photographic layer. Bonding strength between the support and the emulsion layer is evaluated according to the number of the removed boxes as follows:

AA: the removed boxes are zero.

BB: the removed boxes are 1 to 2.

CC: the removed boxes are 3 to 4.

DD: the removed boxes are not less than 5.

ii) The following test is carried to evaluate the bonding in the treatment solutions during the treatments. The edge of the photographic layer is rubbed 15 times with a finger and a length of the emulsion layer peeled from the support at the edge is measured to evaluate as follows:

AA: the length is zero.

BB: the length is less than 2 mm.

CC: the length is 2 to 4.

DD: the length is more than 4.

The treatments are performed according to a tray development process by employing LDS-715 (available from Fuji Photo Film Co., Ltd.) as a developing solution of the treatment solutions and LF-308 (available from Fuji Photo Film Co., Ltd. ) as a developing solution of the treatment solutions.

The photographic films evaluated as "AA" and "BB" in the tests can be employed in practice.

(3) Cracking under low humidity i) The following test is carried out as to the photographic film just after coating of a coating solution for a photographic layer and one after development. Each of the films is cut to a size of 6×8 cm and the emulsion layer is touched with a hand on which a hand cream is spread to leave two fingerprints on the surface of the emulsion layer. The film having the two fingerprints of the hand cream is left in vacuo at a room temperature to 60° C. over a week, and then the surface of the film is observed by viewing whether cracking is produced or not. The film just after formation of the photographic layer is observed with a light reflected on the film and the film subjected to the development is observed with a light passed through the film. Cracking is evaluated as follows:

AA: no cracking is observed

CC: cracking is slightly observed around the fingerprints.

DD: cracking is observed throughout.

The photographic films evaluated as "AA" in the test can be employed in practice.

EXAMPLE 1

The both surfaces of each of a diaxially stretched poly(ethylene terephthalate) film were subjected to a corona discharge treatment and a coating solution for a first subbing layer having the following composition was then coated using a wire bar coater on one surface side of the film so as to have a coated amount of 6 cc/m$^2$. The coated layer was dried at 185° C. for one minute to form the first subbing layer. The first subbing layer was similarly formed on the other surface side of the film.

| First Subbing Layer Composition: | |
|---|---|
| Polyurethane latex (solid content: 40 wt. %; m.p.: 120° C.; mean particle size: 0.1 μm, polyol: polycarbonate type) | 13.6 g |
| Epoxy compound (Sorbitol polyglycidyl ether which has approx. four epoxy groups in a molecule; Denacol EX-614B available from Nagase Kasei Co., Ltd.) | 0.7 g |
| Potassium hydroxide (4 wt. % aqueous solution) | 1.1 g |
| Distilled water | 85.6 g |

The polyurethane latex is prepared from the polyurethane having a basic structure [1] previously described.

A coating solution for a second subbing layer having the following composition was coated on the first subbing layer of one surface side of the film so as to have a coated amount of 9 cc/m$^2$. The second subbing layer was similarly formed on the other surface side (the subbing layer) of the film.

| Second Subbing Layer Composition: | |
|---|---|
| Gelatin | 1.0 g |
| Acetic acid | 0.3 cc |
| Distilled water | 99 cc |

Subsequently, a coating solution for a photographic layer having the following composition (1) was coated on the second subbing layer and was dried to form a photographic layer of a thickness of 6.0 μm (coating amount of silver of 5.0 g/m$^2$). On the photographic layer, a coating solution for a protective layer having the following composition (2) was coated and was dried to form a protective layer. Then, on the second subbing layer opposite to the photographic layer, a coating solution for a backing layer having the following composition (3) was coated and was dried to form a backing layer of a thickness of 5.0 μm. Thus, a photographic material (film) was prepared.

| | |
|---|---|
| Composition (1): | |
| Gelatin | 5 g/m$^2$ |
| Silver halide (Cl: 80 mole %, Br: 19.5 mole %, I: 0.5 mole %) | |
| Tetrachloro auric acid | 0.1 g/m$^2$ |
| Polyethylene acrylate latex (the same as employed in Example 3 described in U.S. Pat. No. 3,525,620) | 1.5 g/m$^2$ |
| Sensitizing dye (3-allyl-5-[2-(l-ethyl)-4-methyl-2-tetrazoline-5-ylidene-ethylidene]rhodamine) | 6 mg/m$^2$ |
| Fogging inhibitor (4-hydroxy-6-methyl-1,3,3a-7-thotrazaindene) | 30 mg/m$^2$ |
| Polyoxyethylene compound | 20 mg/m$^2$ |
| Gelatin hardener (sodium salt of 2-hydroxy-4,6-dichloro-s-trazine) | 60 mg/m$^2$ |
| Surface active agent (sodium p-dodecylbenzenesulfonate) | 40 mg/m$^2$ |
| Composition (2): | |
| Gelatin | 1 g/m$^2$ |
| Matting agent (polymethylmethacrylate powder of a mean particle size of 3.0–4.0 μm) | 0.05 g/m$^2$ |
| Surface active agent (sodium p-dodecylbenzenesulfonate) | 0.03 g/m$^2$ |
| Gelatin hardener (sodium salt of 2-hydroxy-4,6-dichloro-s-trazine) | 0.01 g/m$^2$ |
| Composition (3): | |
| Gelatin | 5 g/m$^2$ |
| Gelatin hardener (sodium salt of 2-hydroxy-4,6-dichloro-s-trazine) | 0.01 g/m$^2$ |
| Matting agent (the same polymethylmethacrylate powder as employed in Composition (2)) | 0.03 g/m$^2$ |
| Polyethylene acrylate latex (the same as employed in Composition (1)) | 50 g/gelatin of 100 g |

-continued

| | |
|---|---|
| Dye (dyes (1), (2) and (3) described below of (1):(2):(3) = 1:1:1 by weight) | 0.3 g/m$^2$ |

Dye (1):

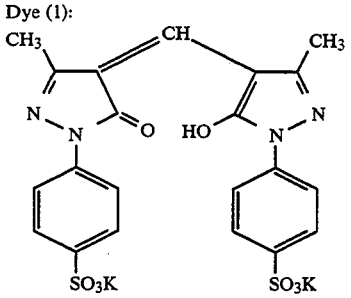

Dye (2):

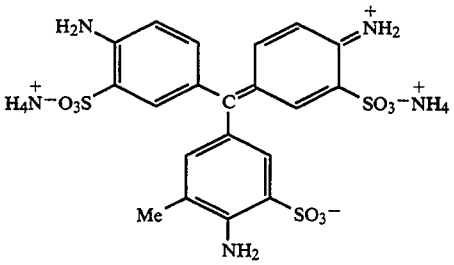

Dye (3):

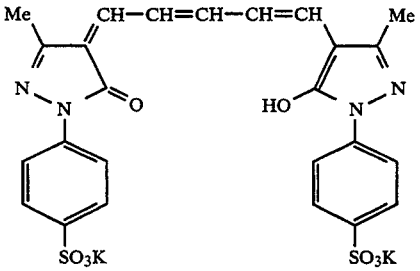

EXAMPLE 2

The procedures of Example 1 were repeated except for using a coating solution for the first subbing layer having the following composition, to prepare a photographic material.

| First Subbing Layer Composition: | |
|---|---|
| Polyurethane latex (the same one as employed in Example 1) | 13.6 g |
| Sodium 2,4-dichloro-6-hydroxy-s-triazine (1.6 wt. % solution) | 10.0 g |
| Potassium hydroxide (4 wt. % aqueous solution) | 1.1 g |
| Distilled water | 75.3 g |

EXAMPLE 3

The procedures of Example 1 were repeated except for using a coating solution for the first subbing layer having the following composition, to prepare a photographic material.

| First Subbing Layer Composition: | |
|---|---|
| Polyurethane latex (the same one as employed in Example 1) | 13.6 g |
| Epoxy compound (Sorbitan polyaglycidyl ether which has approx. four epoxy groups in a molecule 1 wt. % solution; Denacol EX-651A available from Nagase Kasei Co., Ltd.) | 68.2 g |
| Potassium hydroxide (4 wt. % aqueous solution) | 1.1 g |
| Distilled water | 18.1 g |

REFERENCE EXAMPLE 1

The procedures of Example 1 were repeated except for using a coating solution for the first subbing layer having the following composition, to prepare a photographic material.

| First Subbing Layer Composition: | |
|---|---|
| Polyurethane latex (the same one as employed in Example 1) | 13.6 g |
| Potassium hydroxide (4 wt. % aqueous solution) | 1.1 g |
| Distilled water | 85.3 g |

COMPARISON EXAMPLE 1

The procedures of Example 1 were repeated except for using a coating solution for the first subbing layer having the following composition, to prepare a photographic material.

| First Subbing Layer Composition: | |
|---|---|
| Styrene/butadiene copolymer latex (Styrene/butadiene = 68/32 by weight; solid content: 43 wt. %) | 26.0 g |
| Sodium 2,4-dichloro-6-hydroxy-s-triazine 1.6 wt. % solution) | 18.4 g |
| Sodium laurylbenzensulfonate (1 wt. % aqueous solution) | 2.0 g |
| Distilled water | 53.8 g |

COMPARISON EXAMPLE 2

The procedures of Example 1 were repeated except for using a coating solution for the first subbing layer having the following composition and changing the coated amount of the first subbing layer from 6 cc/m$^2$ to 9 cc/m$^2$, to prepare a photographic material.

| First Subbing Layer Composition: | |
|---|---|
| Poly vinylidene chloride latex (vinylidene chloride/methacrylic acid/methylacrylate/methylmethacrylate/acrylonitrile = 90/1/4/4/1 by weight; solid content: 50 wt. %) | 19.0 g |
| Sodium 2,4-dichloro-6-hydroxy-s-triazine (4.0 wt. % solution) | 7.0 g |
| Sodium hydroxide (4 wt. % aqueous solution) | 1.1 g |
| Colloidal silica | 3.5 g |
| Distilled water | 69.4 g |

EXAMPLE 4

The procedures of Example 1 were repeated except for using a coating solution for the first subbing layer having the following composition, to prepare a photographic material.

| First Subbing Layer Composition: | |
|---|---|
| Polyurethane latex (the same one as employed in Example 1) | 13.6 g |
| Epoxy compound (Sorbitol polyglycidyl ether; Denacol EX-614B available from Nagase Kasei Co., Ltd.) | 0.7 g |
| Distilled water | 86.4 g |

EXAMPLE 5

The procedures of Example 1 were repeated except for using a coating solution for the first subbing layer having the following composition, to prepare a photographic material.

| First Subbing Layer Composition: | |
|---|---|
| Polyurethane latex (the same one as employed in Example 1) | 13.6 g |
| Sodium 2,4-dichloro-6-hydroxy-s-triazine (1.6 wt. % solution) | 10.0 g |
| Distilled water | 76.4 g |

REFERENCE EXAMPLE 2

The procedures of Example 1 were repeated except for using a coating solution for the first subbing layer having the following composition, to prepare a photographic material.

| First Subbing Layer Composition: | |
|---|---|
| Polyurethane latex (the same one as employed in Example 1) | 13.6 g |
| Distilled water | 86.4 g |

EXAMPLE 6

The procedures of Example 1 were repeated except for using a coating solution for the first subbing layer having the following composition, to prepare a photographic material.

| First Subbing Layer Composition: | |
|---|---|
| Polyurethane latex (solid content: 30 wt. %; m.p.: 150° C.; mean particle size: 0.02 μm; polyol: aliphatic polyester) | 18.1 g |
| Epoxy compound (Sorbitol polyglycidyl ether; Denacol EX-614B available from Nagase Kasei Co., Ltd.) | 0.9 g |
| Distilled water | 81.0 g |

The polyurethane latex is prepared from the polyurethane having a basic structure [2] ($X_1$: $—C_2H_4—$, $Y_1$: $—C_6H_{12}—$, $Z_1$: phenylene) previously described.

REFERENCE EXAMPLE 3

The procedures of Example 1 were repeated except for using a coating solution for the first subbing layer having the following composition, to prepare a photographic material.

| First subbing Layer Composition: | |
|---|---|
| Polyurethane latex | 18.1 g |

-continued

| First subbing Layer Composition: | |
|---|---|
| (the same one as employed in Example 6) | |
| Distilled water | 11.9 g |

EXAMPLE 7

The procedures of Example 1 were repeated except for using a coating solution for the first subbing layer having the following composition, to prepare a photographic material.

| First Subbing Layer Composition: | |
|---|---|
| Polyurethane latex (solid content: 30 wt. %; m.p.: 120° C.; mean particle size: 0.02 μm; polyol: polyester containing poly(ethylene terephthalate)) | 18.1 g |
| Epoxy compound (Sorbitol polyglycidyl ether; Denacol EX-614B available from Nagase Kasei Co., Ltd.) | 0.9 g |
| Distilled water | 81.0 g |

The polyurethane latex is prepared from the polyurethane having a basic structure [3] ($X_2$: $—C_2H_4—$, $Y_2$: $—C_6H_{12}—$, $Z_2$: phenylene) previously described.

REFERENCE EXAMPLE 4

The procedures of Example 1 were repeated except for using a coating solution for the first subbing layer having the following composition, to prepare a photographic material.

| First Subbing Layer Composition: | |
|---|---|
| Polyurethane latex (the same one as employed in Example 7) | 18.1 g |
| Distilled water | 81.9 g |

As for photosensitive materials obtained in the examples, the bonding strength and the cracking were evaluated according to the measuring methods (1), (2) and (3) as described previously. The results are set forth in Table 1.

TABLE 1

| | Bonding strength | | | | |
|---|---|---|---|---|---|
| | After coating of emulsion | In treating solution | After treatment | Under high humidity | Cracking |
| Ex. 1 | AA | AA | AA | AA | AA |
| Ex. 2 | AA | AA | AA | AA | AA |
| Ex. 3 | AA | AA | AA | AA | AA |
| Ref. Ex. 1 | DD | DD | DD | DD | — |
| Com. Ex. 1 | AA | AA | AA | AA | CC |
| Com. Ex. 2 | AA | AA | AA | CC | AA |
| Ex. 4 | AA | AA | AA | AA | AA |
| Ex. 5 | AA | AA | AA | AA | AA |
| Ref. Ex. 2 | DD | DD | DD | DD | — |
| Ex. 6 | AA | AA | AA | AA | AA |
| Ref. Ex. 3 | DD | DD | DD | DD | AA |
| Ex. 7 | AA | AA | AA | AA | AA |
| Ref. Ex. 4 | DD | DD | DD | DD | AA |

Table 1 shows that the material obtained in Comparison Example 1 gives a satisfactory bonding strength between the support and the photographic layer under a high humidity but produces cracking under a low humidity and the material obtained in Comparison Example 2 does not give a satisfactory bonding strength under a high humidity but produces no cracking under a low humidity. In contrast, the materials obtained in Examples 1–7 are excellent in both of the bonding strength under a high humidity and occurrence of cracking under a low humidity.

As is apparent from comparison of Reference Example 1 and Examples 1–3, those of Reference Example 2 and Examples 4 and 5, Reference Example 3 and Example 6 and Reference Example 4 and Example 7, in the case of using no bridging agent (the triazine or epoxy compound), the bonding strengths are extremely reduced.

In the following Examples, the obtained materials are evaluated as to reticulation of a second subbing layer and pinhole of a photographic film in addition to the above bonding strength and the cracking. Further, breaking extension and stress at 100% elongation of a polymer employed for a first subbing layer are determined.

The measuring methods performed in the example are explained below.

(4) breaking extension and stress at 100% elongation of polymer

A Teflon film treated by corona discharge is fixed on a smooth surface of a base, and a glass plate frame of a thickness of 0.5 mm having a hole of 10 cm×10 cm is placed on the film to be fixed. Then, a polymer latex used for the first subbing layer is dropped in the mount of several ml on the hole portion of the glass frame and the dropped latex is smoothed out within the hole with a glass bar, the drop being adjusted to give a final thickness of 50 μm. After the latex layer is dried at 25° C., 80% RH for a day, the layer is heated at 185° C. for 3 minutes and is allowed to stand 25° C., 50% RH for a day. Thereafter, the layer (test film) is peeled from the Teflon film and a portion having no defect of the test film is cut to prepare a sample. A tensile test of the sample is performed according to a physical testing method of vulcanized rubber of Japanese Industrial Standards (K 6301-1975). The breaking extension and stress at 100% elongation of the sample are measured.

(5) Reticulation of two subbing layer

As to a film just after formation of the first subbing layer, the condition (the degree of unevenness) of a surface of the subbing layer is evaluated as haze. The haze of the film is measured using a haze meter (NDH-1001P/SZ-Σ90 type available from Nippon Densyoku Kogyo Co., Ltd.) just after entering the film in a room under a constant temperature and humidity (30° C., 30% RH), and is further measured after 30 minutes from the entering. The difference (Δ) between these hazes is calculated. The reticulation of the first subbing layer is evaluated as follows:

AA: the difference (A) is not more than 1%

CC: the difference (A) is in the range of more than 1% and not more than 3%

DD: the difference (A) is more than 3%

(6) Pinhole of photographic film

In the course that a photographic film is transformed from a washing step to a drying step in an automatic developing machine, the film is picked out. A surface of the emulsion layer of the film and a roughened surface of a sand paper (#320) are put together, and such composite is transformed to a drying step to allow to dry. The resultant film is arranged on a light of a high illumination to observe the condition of the produced pinhole. The pinhole of the photographic film is evaluated as follows:

AA: no pinhole is observed

CC: indistinct pinhole is observed

DD: distinct pinhole is observed

EXAMPLE 8

The both surfaces of each of a diaxially stretched poly(ethylene terephthalate) film were subjected to a glow discharge treatment in vacuo and a coating solution for a first subbing layer having the following composition was then coated using a wire bar coater on one surface side of the film so as to have a coated amount of 6 cc/m$^2$. The coated layer was dried at 185° C. for one minute to form the first subbing layer. The first subbing layer was similarly formed on the other surface side of the film.

| First Subbing Layer Composition: | |
|---|---|
| Polyurethane latex (solid content: 30 wt. %; Ucoat UX-4560 available from Sannyo Chemical Co., Ltd.) | 13.6 g |
| Sodium 2,4-dichloro-6-hydroxy-s-triazine (1.6 wt. % solution) | 10.0 g |
| Potassium hydroxide (4 wt. % aqueous solution) | 1.1 g |
| Distilled water | 70.8 g |

Except for the formation of the first subbing layer, the processes of Example 1 were repeated to prepare a photographic material.

EXAMPLE 9

The procedures of Example 8 were repeated except for using a coating solution for the first subbing layer having the following composition, to prepare a photographic material.

| First Subbing Layer Composition: | |
|---|---|
| Polyurethane latex (solid content: 30 wt. %; Super flex 110 available from Dai-Ichi Kogyo Co., Ltd.) | 18.1 g |
| Sodium 2,4-dichloro-6-hydroxy-s-triazine (1.6 wt. % solution) | 10.0 g |
| Potassium hydroxide (4 wt. % aqueous solution) | 1.1 g |
| Distilled water | 68.8 g |

EXAMPLE 10

The procedures of Example 8 were repeated except for using a coating solution for the first subbing layer having the following composition, to prepare a photographic material.

| First Subbing Layer Composition: | |
|---|---|
| Polyurethane latex (solid content: 30 wt. %; Super flex 126 available from Dai-Ichi Kogyo Co., Ltd.) | 18.1 g |
| Sodium 2,4-dichloro-6-hydroxy-s-triazine 1.6 wt. % solution) | 10.0 g |
| Potassium hydroxide (4 wt. % aqueous solution) | 1.1 g |
| Distilled water | 70.8 g |

EXAMPLE 11

The procedures of Example 8 were repeated except for using a coating solution for the first subbing layer having the following composition, to prepare a photographic material.

| First Subbing Layer Composition: | |
|---|---|
| Acrylic resin latex (solid content: 27 wt. %; C-37 available from Nippon Acryl Co., Ltd.) | 20.1 g |
| Sodium 2,4-dichloro-6-hydroxy-s-triazine (1.6 wt. % solution) | 10.0 g |
| Potassium hydroxide (4 wt. % aqueous solution) | 1.1 g |
| Distilled water | 70.8 g |

EXAMPLE 12

The procedures of Example 8 were repeated except for using a coating solution for the first subbing layer having the following composition, to prepare a photographic material.

| First Subbing Layer Composition: | |
|---|---|
| Styrene/butadiene copolymer latex (styrene/butadiene/acrylic acid/ divinylbenzene = 65/29/2/1, by weight; solid content: 30 wt. %) | 1.1 g |
| Poly vinylidene chloride latex (vinylidene chloride/methacrylic acid/ methylacrylate/methylmethacrylate/ acrylonitrile = 90/1/4/4/1 by weight; solid content: 50 wt. %) | 8.7 g |
| Sodium 2,4-dichloro-6-hydroxy-s-triazine (1.6 wt. % solution) | 10.0 g |
| Potassium hydroxide (4 wt. % aqueous solution) | 1.1 g |
| Distilled water | 79.1 g |

COMPARISON EXAMPLE 3

The procedures of Example 8 were repeated except for using a coating solution for the first subbing layer having the following composition, to prepare a photographic material.

| First subbing Layer Composition: | |
|---|---|
| Acrylic resin latex (solid content: 27 wt. %; JP-198 available from Nippon Acryl Co., Ltd.) | 20.1 g |
| Sodium 2,4-dichloro-6-hydroxy-s-triazine (1.6 wt. % solution) | 10.0 g |
| Potassium hydroxide (4 wt. % aqueous solution) | 1.1 g |
| Distilled water | 68.8 g |

COMPARISON EXAMPLE 4

The procedures of Example 8 were repeated except for using a coating solution for the first subbing layer having the following composition, to prepare a photographic material.

| First subbing Layer Composition: | |
|---|---|
| Styrene/butadiene copolymer latex (styrene/butadiene/acrylic acid/ | 18.1 g |

-continued

| First subbing Layer Composition: | |
|---|---|
| methylacrylate = 59/37/2/2, by weight; solid content: 30 wt. %) | |
| Sodium 2,4-dichloro-6-hydroxy-s-triazine (1.6 wt. % solution) | 10.0 g |
| Potassium hydroxide (4 wt. % aqueous solution) | 1.1 g |
| Distilled water | 70.8 g |

EXAMPLE 13

Poly(ethylene terephthalate) having intrinsic viscosity of 0.68 was melted at 280° C. to extrude on a cooling drum, and was stretched 3.5 times in the lengthwise direction using a roll at 100° C. Then, on one surface side of the stretched poly(ethylene terephthalate) film, a coating solution for a first subbing layer having the following composition was coated using a wire bar coater so as to have a coated amount of 12 cc/m$^2$. The coated layer was dried at 185° C. for one minute to form the (first) subbing layer. The first subbing layer was similarly formed on the other surface side of the film.

| First Subbing Layer Composition: | |
|---|---|
| Polyurethane latex (solid content: 30 wt. %; Ucoat UX-4560 available from Sannyo Chemical Co., Ltd. which is the same as used in the Example 8) | 36.2 g |
| Sodium 2,4-dichloro-6-hydroxy-s-triazine (1.6 wt. % solution) | 20.0 g |
| Potassium hydroxide (4 wt. % aqueous solution) | 2.2 g |
| Distilled water | 41.6 g |

The film on which the first subbing layer was formed, then, was stretched 3.5 times in the widthwise direction at 160° C. to prepare a diaxially stretched film (thickness: 100 μm) with the first subbing layer. The both surfaces of the resultant film were subjected to a corona discharge treatment.

Subsequently, a second subbing layer, a photographic layer, a protective layer and a backing layer were formed on the film in the same manner as Example 1. Thus, a photographic material (film) was prepared.

EXAMPLE 14

The procedures of Example 13 were repeated except for using a coating solution for the first subbing layer having the following composition, to prepare a photographic material.

| First Subbing Layer Composition: | |
|---|---|
| Styrene/butadiene copolymer latex (styrene/butadiene/acrylic acid/ divinylbenzene = 65/29/2/1, by weight; solid content: 30 wt. %) | 7.2 g |
| Poly vinylidene chloride latex (vinylidene chloride/methacrylic acid/ methylacrylate/methylmethacrylate/ acrylonitrile = 90/1/4/4/1 by weight; solid content: 50 wt. %) | 17.4 g |
| Sodium 2,4-dichloro-6-hydroxy-s-triazine (1.6 wt. % solution) | 20.0 g |
| Potassium hydroxide (4 wt. % aqueous solution) | 2.2 g |
| Distilled water | 53.2 g |

COMPARISON EXAMPLE 5

The procedures of Example 13 were repeated except for using a coating solution for the first subbing layer having the following composition, to prepare a photographic material.

| First subbing Layer Composition | |
|---|---|
| Styrene/butadiene copolymer latex (styrene/butadiene/acrylic acid/ methylacrylate = 59/37/2/2, by weight; which is the same as used in Com, Ex. 4; solid content: 30 wt. %) which is the same as used in the Example 8) | 36.2 g |
| Sodium 2,4-dichloro-6-hydroxy-s-triazine 1.6 wt. % solution) | 20.0 g |
| Potassium hydroxide (4 wt. % aqueous solution) | 2.2 g |
| Distilled water | 41.6 g |

The breaking elongation and stress at 100% elongation of polymers employed in the first subbing layers of the resultants photographic materials were determined according to the measuring method (4) as described previously. Further, bonding strength between support and emulsion layer, bonding strength under high humidity, cracking under low humidity, reticulation of the second subbing layer and pinhole of the photographic film were evaluated according to the measuring methods (1), (2), (3), (5) and (6) as described previously. The results are set forth in Tables 2 and 3.

TABLE 2

| Polymer of first subbing layer | The polymer used-Example | Breaking elongstion (%) | Stress at 100% elongation (kg/cm$^2$) |
|---|---|---|---|
| Polyurethane latex (Ucoat UX-4560) | Exs. 8, 13 | 250 | 300 |
| Polyurethane latex (Super flex 110) | Ex. 9 | 13 | — |
| Polyurethane latex (Super flex 126) | Ex. 10 | 140 | 280 |
| Acrylic resin latex (C-37) | Ex. 11 | 80 | — |
| Blend of styrene/butadiene copolymer and polyvinylidene chloride | Exs. 12, 14 | 230 | 150 |
| Acrylic resin latex (JP-198) | Com. Ex. 3 | 980 | 25 |
| Styrene/butadiene copolymer (St/Bd/AA/MA = 59/37/2/2) | Com. Ex. 4, 5 | 490 | 20 |

TABLE 3

| | Bonding strength | | | | | | |
|---|---|---|---|---|---|---|---|
| | After coating of emulsion | In treating solution | After treatment | Under high humidity | Reticulation | Pinhole | Cracking |
| Ex. 8 | AA | AA | AA | AA | AA | AA | AA |
| Ex. 9 | AA | AA | AA | AA | AA | AA | AA |
| Ex. 10 | AA | AA | AA | AA | AA | AA | AA |
| Ex. 11 | AA | AA | AA | AA | AA | AA | AA |
| Ex. 12 | AA | AA | AA | AA | AA | AA | AA |
| Com. Ex. 3 | AA | AA | AA | AA | DD | DD | DD |
| Com. Ex. 4 | AA | AA | AA | AA | DD | DD | DD |
| Ex. 13 | AA | AA | AA | AA | AA | AA | AA |
| Ex. 14 | AA | AA | AA | AA | AA | AA | AA |
| Com. Ex. 5 | AA | AA | AA | AA | CC | CC | DD |

As is apparent from Table 1, the materials obtained in Examples 8–14 do not show occurrences of pinhole, reticulation and cracking under low humidity. Further, the materials exhibit a satisfactory bonding strength. Hence, these materials show stably excellent characteristics under various environments. In contrast, the materials obtained in Comparison Examples 3–5, in which polymers employed for the first subbing layers do not satisfy the ranges of breaking extension and stress at 100% elongation, do not show satisfactory characteristics in occurrences of pinhole, reticulation and cracking under low humidity although they show high bonding strength.

We claim:

1. A photographic material comprising a support of a polyester film, a first subbing layer provided thereon, a second subbing layer provided on the first subbing layer and a photographic layer provided on the second subbing layer, wherein the first subbing layer is a layer of polyurethane latex cured with an epoxy compound or a dichloro-s-triazine derivative, and the second subbing layer is a hydrophilic colloid layer comprising gelatin.

2. The photographic material as defined in claim 1, wherein the polyurethane latex has breaking elongation of not more than 300% or stress at 100% elongation of not less than 130 kg/cm$^2$.

3. The photographic material as defined in claim 1, wherein the polyurethane latex is a latex of polyurethane derived from an iscocyanate compound and at least one polyol selected from the group consisting of polyol containing a polycarbonate unit, polyol of an aliphatic polyester and polyol containing a poly(ethylene phthalate) unit.

4. The photographic material as defined in claim 1, wherein the epoxy compound has epoxy groups of not less than four.

* * * * *